US005268721A

United States Patent [19]

Day

[11] Patent Number: 5,268,721

[45] Date of Patent: Dec. 7, 1993

[54] POSITIVE AIR PRESSURE TONER CONFINING APPLICATOR

[75] Inventor: Gene F. Day, Hillsborough, Calif.

[73] Assignee: Phoenix Precision Graphics, Inc., Sunnyvale, Calif.

[21] Appl. No.: 998,458

[22] Filed: Dec. 30, 1992

Related U.S. Application Data

[63] Continuation-in-part of Ser. No. 930,779, Aug. 17, 1992, Pat. No. 5,231,455.

[51] Int. Cl.[5] ..... G03G 15/10

[52] U.S. Cl. ..... 355/256; 118/660

[58] Field of Search ..... 355/256; 118/659-662, 118/647, 652; 430/103

[56] References Cited

U.S. PATENT DOCUMENTS 3,196,832 7/1965 Zin ..... 118/660

3,955,976 5/1976 Honjo et al. ..... 430/103

4,878,090 10/1989 Lunde ..... 355/256

5,063,413 11/1991 Domoto et al. ..... 355/296

*Primary Examiner*—Joan H. Pendegrass

*Attorney, Agent, or Firm*—Schneck & McHugh

[57] ABSTRACT

A method and apparatus for applying liquid toner to a recording medium using a toner applicator, wherein the applicator contains a channel for toner flow peripherally surrounded by an air channel. The recording medium carrying a latent electrostatic image is directed past the channel in the toner applicator. The channel in the applicator contains toner and is in fluid communication with the recording medium. Air under pressure is introduced into the air channel surrounding the toning channel thus providing a barrier around the toning channel, such that the toner is confined within the channel, thereby preventing unwanted leakage of liquid toner from the channel.

3 Claims, 2 Drawing Sheets

POSITIVE AIR PRESSURE TONER CONFINING APPLICATOR

CROSS REFERENCE TO RELATED APPLICATION

This is a continuation-in-part of U.S. patent application Ser. No. 07/930,779 filed Aug. 17, 1992, now U.S. Pat. No. 5,231,455.

TECHNICAL FIELD

The present invention pertains to the field of electoostatic printing and copying. Specifically, the present invention pertains to the application of liquid toner in electrostatic printing and copying.

BACKGROUND ART

In electrostatic printing and copying systems, an electrostatic writing head is commonly used to deposit a latent image of electrical charges onto a recording medium such as a paper web. The paper web carrying the latent image is then directed to a liquid toning applicator which deposits charged toner particles onto the paper web, thereby developing the latent image.

Such liquid toning applicators can be classified as pressure-type or suction-type. In suction-type applicators, a liquid pump is used to draw toner from a toner reservoir into the applicator and across one or more channels in the face of the applicator, wherein the toner comes into contact with the paper web. The flexible web series to seal the face of the applicator thus permitting the pump, connected to the applicator outlet, to create a vacuum or suction in the channels and thereby draw toner into the applicator from a toner reservoir. The outlet of the toner pump returns the spent toner to the reservoir. In this manner a continuous recirculation of the toner occurs. The flexible paper web thus forms a liquid seal around the periphery of the applicator assuring that pressure differences are maintained. The face of the applicator must be oriented upward to insure that the toner is not spilled. If the paper web is pulled away from the applicator, damaged, or is simply depleted, the vacuum seal is broken, all liquid pumping ceases, and the toner flows gravitationally back into the toner reservoir. As a result, suction-type toner applicators are virtually leak-proof.

Despite the advantage of leak protection, suction-type applicators are severely limited by slow toning speeds. Since the paper web comes into contact with the toner in a channel of decreased pressure, the edges of the channel must support the web against the inward force. For this reason, the channels must be no greater than about a tenth of an inch wide in order to prevent the paper web from being pulled down into the toning channel and cutting off the flow of toner. To compensate for this narrow channel size, several parallel channels are incorporated into the face of the applicator. A practical design has these narrow channels aligned perpendicular to the direction of movement of the web. Such toning applicator systems are referred to as "cross-flow" applicators.

As the speed of the web passing over a cross-flow applicator is increased, more and more channels are required in order to insure that adequate toning occurs. As additional channels are incorporated into the applicator, the paper web is subjected to greater sliding friction. Furthermore, narrower channels, which can typically be up to 36 inches long, require stronger suction from the liquid pump in order to get the toner to quickly flow therethrough. This adds to the downward force on the paper web, and further increases the sliding friction. As web speeds approach 2 inches per second, the speed necessary for high speed plotting or printing, the number of required channels is so great that the sliding friction of the web against the applicator becomes impractical. Thus, suction-type applicators are restricted optimally to web speeds below approximately 1 inch per second.

Pressure-type applicators function in a slightly different manner. Instead of using a vacuum to draw toner across the face of the applicator, the toner is pumped out of a toner reservoir using positive pressure. In one embodiment of a pressure-type applicator the toner is pushed by positive pressure through a channel in the applicator and finally received by an inlet port on the opposite side of the applicator channel for continuous recirculation. In order to compensate for the positive pressure exerted on the paper web by the pressurized toner, a backing surface is placed behind the web to hold it against the applicator. Thus, pressure-type applicators do not create suction in the applicator channels, and sliding friction of the paper web is greatly reduced.

Since suction is no longer a problem, pressure-type applicators are freed from the "narrow-channel" geometries of suction-type applicators. For instance, the channel can be almost the full size of the applicator's contacting surface, extending across the entire width of the paper web, and the full extent of the applicator in the direction of movement of the web. One such "full-width" channel can be as effective as ten or twenty cross-flow channels, and almost totally without paper sliding friction. As a result, far higher web speeds can be employed without system compromises or image quality sacrifices. Furthermore, the flow of the toner may be parallel to the paper web direction, i.e. the toner in the channel may flow opposite or in the same direction as the paper movement. Such a short but wide channel requires reduced pressures and liquid velocities, both of which characteristics benefit the toning process.

In another embodiment of the pressure-type applicator, a rotating "toning""roller in contact with the web is either wetted by partial emersion or else sprayed with liquid toner. In either case a bucket or funnel must be used to contain the toner liquid and prevent leakage. By proper design the toning roller can be used as well for drying the image after toning. Such a roller system works well at low web speeds but is not suitable for high web speeds. The toner containing bucket also presents great difficulties if used for a single-applicator system for multi-color toning. This is discussed below.

Although pressure-type applicators offer advantages such as reduced friction and increased channel size, they are hampered by toner leakage. Even when precisely designed and constructed, toner leakage still occurs around the edges of the applicator. Often there is no attempt to minimize leakage, and the flow of toner is simply collected by a bucket or funnel situated underneath the applicator, and then recirculated. Using buckets increases the cost of the system, and the buckets also require occasional cleaning. Furthermore, in applicator systems in which a single applicator is used for several different colored toners, such buckets result in cross color contamination due to toner mixing in the buckets.

Therefore it is an object of this invention to provide a toner applicator having the speed advantages of a pressure-type applicator, without toner leakage, and which is suitable for applying multi-colored toners from a single applicator.

A further object of this invention is to provide such a toning applicator with built-in drying means in the form of an air knife for removing excess liquid from the paper web.

SUMMARY OF THE INVENTION

This object has been achieved with a high speed pressure-type toner applicator which employs a surrounding channel of high pressure air to confine toner to the face of the applicator. This is accomplished by peripherally surrounding the face of a pressure-type applicator with a channel into which high pressure air is introduced, such that a barrier is created surrounding the applicator face and confining the toner thereon.

It has been found that, as long as the air pressure in the peripheral passage or channel exceeds the pressure of the liquid toner, the liquid is completely contained and no leakage occurs. In order to prevent excess introduction of air bubbles into the toner, a flat upper surface or backing electrode on the opposite side of the paper web from the applicator is urged downward against the paper web, causing the paper to remain in close contact with the upper (contacting) surfaces of the applicator thus providing a sealing action as in the suction type applicator. A flat upper applicator surface is thus positioned in intimate contact with the paper thus separating the dry air channel from the liquid-filled toning channel. This serves as a seal which minimizes the flow of air into the liquid channel.

A pressure sensor or sensors are employed to insure that the air pressure always exceeds the liquid pressure. If, for any reason, the air pressure should drop to the same level as the liquid pressure, thus threatening leakage of liquid toner, the sensor output is used to automatically shut down the liquid pump in order to prevent toner spillage. For this purpose, a differential-type pressure sensor, which monitors the difference between air pressure and liquid pressure has been found to be useful. In practice the air pressure is maintained at about 0.2 to 0.3 pounds per square inch (psi) by a blower such as the RDC Revaflow Radial Blower, Model RDC12HH, manufactured by EG&G Rotron, Saugerties, N.Y. The liquid pressure is maintained at least 0.01 to 0.1 psi lower than the air pressure to provide a safety margin so as to insure that any fluid flow over the flat sealing surface consists solely of air. When shutting down or changing liquids in the liquid channel, the air pressure is maintained so as to keep the flat separating (sealing) surface and the air passage dry at all times. This eliminates any need to clean the sealing surface or the air channel.

While the above liquid containment method can be used on all four sides of the applicator, thus completely surrounding the liquid channel with air at higher pressure, it has been found useful to employ the method only on three sides and to employ a different type of air containment of the liquid on the side or edge towards which the paper is moving.

The flat (sealing) surface reduces air flow into the lower pressure liquid channel to a very low level. The inherent minor roughness of the paper surface does allow some seepage of air but the amount is minor and the resulting air bubbles in the liquid are harmless. Typically, the air velocity for the air seeping slowly into the liquid between the flat surface and the paper is typically about 2 to 25 inches per second. Because of the smallness of the gap between the flat upper surface of the applicator and the paper, this corresponds to only about 0.001 to 0.10 cubic feet per minute and this is only a small part of the air blower capacity which is approximately 5 to 10 cubic feet per minute. Thus, even with significant leakage of air into the liquid toner such as might be caused by slight mechanical mis-fit of the parts, there remains adequate air production capacity to prevent toner leakage and to operate the air knife described below.

If the flat sealing surface were to be greatly reduced in width, i.e. made very narrow as in a knife edge, and withdrawn slightly away from the paper, a very high velocity flow of air from the air passage into the liquid channel would result. This configuration comprises an air-knife which is well-known as a web drying means if positioned across the entire web downstream of the wetted area. Thus the flat sealing surface is used only along the lateral edges of the applicator and along the upstream broad edge where the moving web enters the toning zone. The air knife geometry is used along the broad paper "exit" edge so as to contain the liquid and remove excess liquid from the web as it leaves the applicator upper surface.

The best configuration is to provide toner flow towards the knife edge, i.e. parallel to the paper direction, so that the liquid and the air flow towards each other. A drain slit is then provided where the two flows collide so that the spent toner and the air mixture can be removed (together) downward without pressure build-up in the vicinity of the air knife. Because the air knife is as wide as the paper web, the amount of air flowing between it and the paper is large, typically 5 to 10 cubic feet per minute. The shear force of this air moving at high speed against the paper motion effectively removes the liquid toner from the web, thus preventing spillage and, at the same time, drying the paper web.

It would also be possible to employ four surrounding air knives so that the entire wetted area would be surrounded by air knives. The shear force of the air against the paper would effectively prevent any toner leakage. It is generally more economical to employ flat sealing surfaces except where actual liquid removal is needed, i.e. along the downstream edge of the applicator where the wet paper exits the applicator.

A full-width toner applicator is employed in a web-based electrographic printer in which the toning is done while moving the web across the exposed top of the applicator. Toner is supplied to the face of the applicator via slits which communicate with toner reservoirs. After the application of toner to the paper web, excess toner is removed using a knife edge of air which directs the excess toner into a drainage slit in communication with a drainage tank. Since the toner is confined to the face of the applicator, there is no leakage over the edges of the applicator and the need for buckets is eliminated. Additionally, the toner can be removed from the drainage tank and the tank can then be cleaned. As a result cross color contamination of toners is prevented.

BEST MODE FOR CARRYING OUT THE INVENTION

Figure 1:
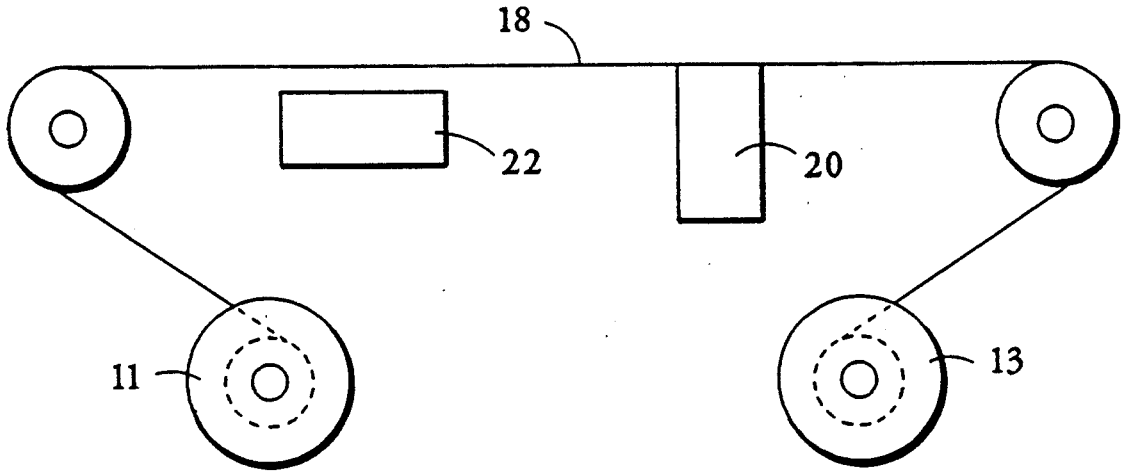
FIG. 1 is a simplified schematic view of an electrostatic printing and copying apparatus utilizing a toner applicator in accord with the present invention.

With reference to FIG. 1, an electrostatic printing and copying system is shown, utilizing a toner applicator in accord with the present invention. Paper supply roller 11 and take-up roller 13 accurately position a paper web 18, and maintain tension in the web 18. The toner applicator 20 spans the width of the paper 18. Liquid toner is supplied to the applicator and flows across the entirety of an exposed upper applicator surface, a channel, allowing toner particles to adhere to charged regions of the paper. An electrostatic writing head 22 is located upstream from the toner shoe 20. The head 22 is a scanning head which moves across the width of the paper 18, similar to scanning heads of dot matrix printers. However, instead of applying ink to paper by means of a ribbon, the head 22, having an array of closely spaced wires connected to a high voltage supply, merely deposits an electrostatic charge in an analogous manner, thereby writing a latent image on the paper web 18. Although the following description pertains to the use of a paper web, the present invention may also be used with drum-type electrostatic systems.

Figure 2:
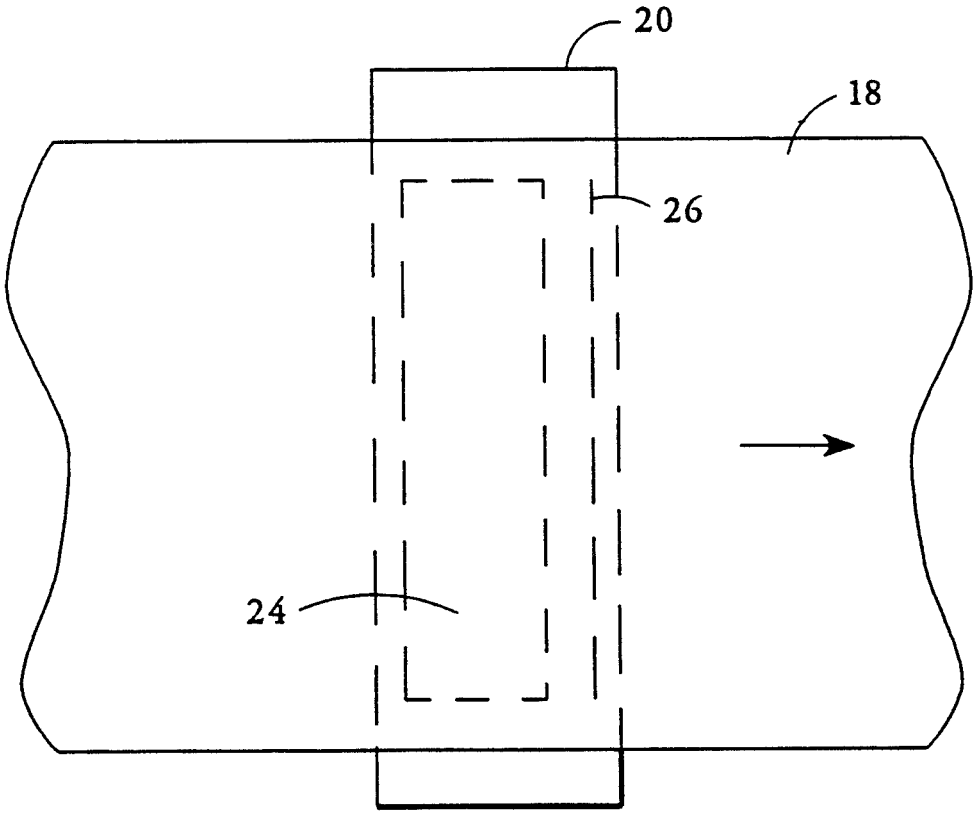
FIG. 2 is a top view of the toning shoe and applicator of FIG. 1 in accord with the present invention.

Referring now to FIG. 2, a partial top view of FIG. 1 is shown in which the alignment of the paper web 18 over toning applicator 20 is more clearly illustrated. As can be seen in FIG. 2, toning applicator 20 spans the entire width of paper web 18. The applicator 20, having a working surface defined by area 24, applies liquid toner across the entire width of web 18 except for small border regions at each edge. Paper web 18 is controlled so that it moves across the toning shoe 20 such that the entire image surface of the web 18 has toner applied thereto via applicator 20. Air knife 26 removes excess toner from the web at the downstream edge of the applicator. Liquid toner in the applicator includes charged particles in suspension which adhere to oppositely charged small regions of the latent image. Excess toner is removed or dries by evaporation after the latent image has been developed by the application of toner and then another pass is made where the next color is written, until all colors have been written in the same way to form a fully developed image. Between passes an air jet cleaner system is used to purge toner from the toner pump, slits and piping to be shared with the next color. Wash fluid is then introduced in order to dissolve any residual toner so as to leave the pump, slits and piping in a clean condition. Jet air is then reintroduced to purge the wash fluid so as to prepare the shared areas for the next color.

Figure 3:
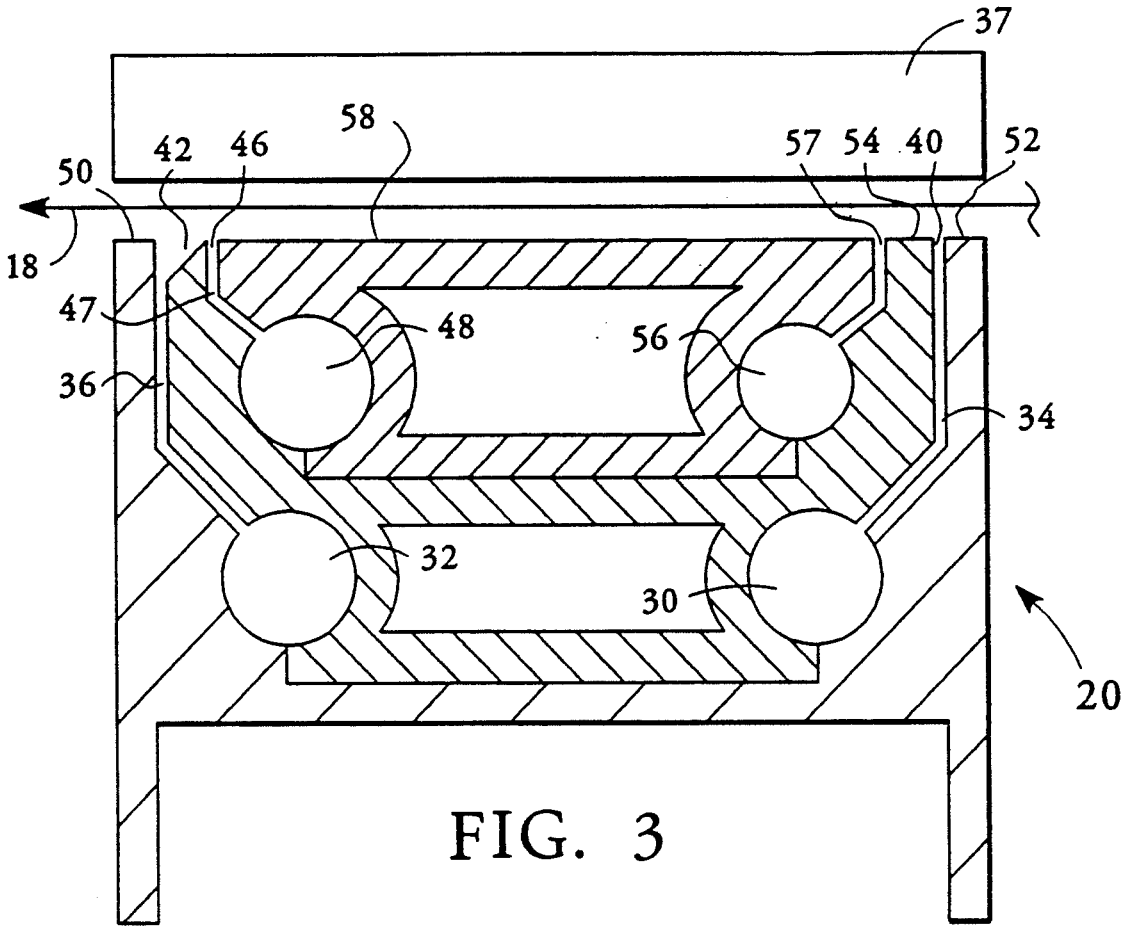
FIG. 3 is a side sectional view of a toner applicator in accord with the present invention.

Following is a more detailed description of the above-mentioned procedure. With reference now to FIG. 3, a side sectional view of the toner applicator 20 of the present invention is shown. Air from an air supply means, not shown, is supplied to airways 30 and 32. Air flows upward through airway slits 34 and 36 until it reaches the upper surface of the applicator which contacts the paper web 18. The air pressure at the topmost ends 40 and 42 of airway slits 34 and 36 is greater than the liquid pressures in the "wet" channel area 58 lying between the topmost ends 40 and 42, so as to fully contain the liquids and so as to prevent leakage of the liquids beyond the long edges of the applicator 20. At the near and far ends of the applicator 20, U-shaped passages or grooves, open at the top, are provided in the upper surface of the ends of the applicator 20 in such a manner as to connect topmost ends 40 and 42 with each other at both the near and the far ends of the applicator 20. These two passages together with the topmost ends 40 and 42 of the airway slits 34 and 36 form a rectangular curtain or "moat" as seen from above, of high pressure air which completely surrounds the wet, exposed channel 58 of the applicator 20 preventing liquid leakage beyond the long edges or the narrow ends of the applicator 20. The paper web 18 is positioned in direct planar contact with the upper surfaces of the applicator 20 so as to substantially prevent air leakage and loss except for the air which escapes inward over the knife edge 46 and into drainage channel 48. This air moat eliminates the need of a bucket to catch any spilled toner and provides for a completely closed toning system in which the toner is fully captured even when in contact with the moving paper web. This prevents evaporation of liquid toner and wash fluid, thus reducing organic hydrocarbon vapors in the vicinity of the printer. An added benefit is that the closed toning system is easily self-cleaned by wash fluid so that manual cleaning is not required. The air pressure is automatically monitored to insure that it is always greater than the maximum liquid pressure thereby insuring no liquid leakage. Should the air pressure, for any reason, fall to the same level as the liquid pressure the liquid pump, not shown, is automatically shut down and a system fault indicated to the operator.

A planar backing member 37, above, i.e. behind the paper 18 holds the paper flat and causes it to resist the pressure of the air and the liquids. The paper 18 remains flat and effectively seals the fluids below wherever it contacts facing surfaces of the applicator 20. Although slight air leakage occurs due to paper roughness and parts tolerances this is not a significant air loss and the air pressure provides a leak free seal for the liquids which are at reduced pressure. Outer contacting surfaces 50 and 52, which are aligned with contacting surface 54, also bear against the paper and substantially prevent air loss beyond the long edges of applicator 20. In addition to holding the paper web in place, the backing member 37 can act as a grounding electrode. That is, the backing member 37 can be used either to keep the paper web at zero volts, or to otherwise control the voltage on the web.

Fresh toner is supplied by a pump, not shown, to toner supply channel 56. The toner is then pumped upward through toner slit 57 as shown until it reaches the paper web 18. The high pressure air of topmost end 40 prevents the toner from moving to the right so that it is forced to travel to the left towards topmost end 42. The upper surface 54 which actually contacts the paper web 18 substantially prevents air from topmost end 40 from leaking into the wet channel area to the left of upper surface 54. A small amount of air may leak into the wet zone where it does no harm. While the toner travels from the toner delivery slit 57 which communicates with toner supply channel 56 towards air knife 46 the actual toning process takes place with a portion of the charged toner particles adhering to the charged latent image. For this purpose, the working surface or channel 58 of the applicator 20 is spaced away from the paper 18, that is, it is recessed slightly below the plane of upper contacting surfaces 54, 50, and 52. The resulting space or gap between the image surface of the paper 18 and the toning channel 58 is preferably in the range 0.003 inches to 0.010 inches and ideally 0.004 to 0.005 inches. Smaller spacings tend to impede fluid flow such that insufficient toner is available for complete toning whereas larger spacings cause a slowing of the toning process resulting in similarly incomplete toning.

The flowing toner approaches the knife edge 46 which is spaced away from the paper surface 18 by a spacing similar to the spacing of toning channel 58 away from the paper, i.e. by 0.003 to 0.010 inches and preferably by 0.004 to 0.005 inches. Between channel 58 and knife edge 46 a drainage slit 47 is positioned so as to allow fluids to freely descend to drainage channel 48. The drainage slit 47 is preferably wider than 0.010 inches in thickness so as to not impede air flow, liquid flow, or a mixed flow downward to drainage channel 48. In this manner the total fluid pressure at the top of slit 47 which separates working surface 58 from knife edge 46 is kept very low, preferably below 0.1 pounds per square inch. All the connecting lines and passages, not shown, which deliver air to topmost end 42 are preferably greater than 0.5 inches in internal diameter so as to assure a sufficient air supply so as to provide no less than 0.2 pounds per square inch and preferably 0.3 pounds per square inch of air pressure at topmost end 42.

This air at relatively high pressure moves to the right between the knife edge 46 and the paper 18 at a velocity preferably greater than 100 feet per second and both the liquid arriving from the right and the air arriving from the left of the drain slit 47 descend downward to drainage channel 48. At the same time, the fluid shear force of the air passing between the knife edge 46 and the paper 18 insures that substantially all of the liquid is removed from the paper 18 resulting in only a very thin film of liquid being carried out by the moving paper web 18. With the paper web 18 moving to the left, i.e. parallel to the toner flow in the gap separating the paper 18 from working surface or channel 58 at a speed of about 2 inches per second this carried out residual film of liquid is preferably less than 0.00004 inches in thickness.

Figure 4:
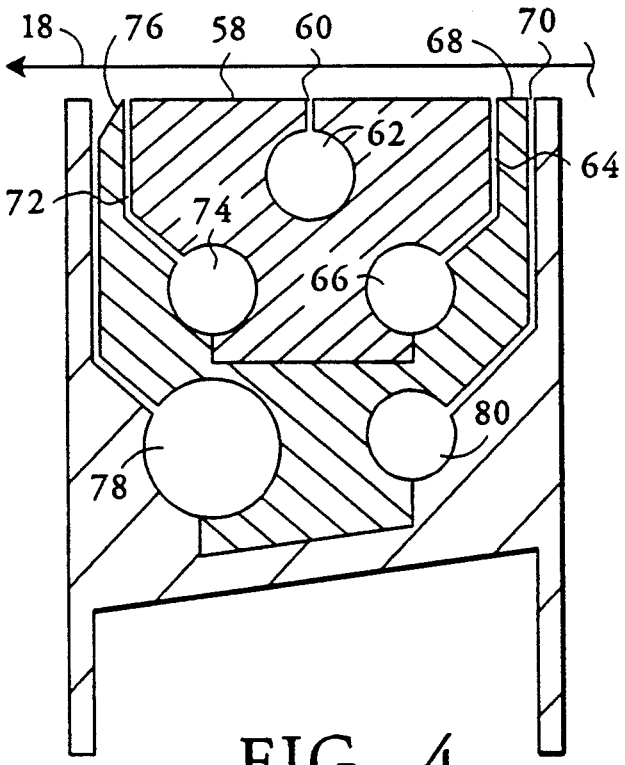
FIG. 4 is a side sectional view of an alternate embodiment of a toner applicator in accord with the present invention.

FIG. 4 shows an alternative embodiment of applicator 20. While the functioning is essentially similar to the applicator of FIG. 3, the toner or wash fluid flows in the gap between the working surface 58 and the paper 18 in both directions from a centrally located toner supply slit 60 connected to toner supply channel 62. A portion of the liquid flow moves "upstream", i.e. against the leftward paper web motion, and downward through a drainage slit 64 as shown into drainage channel 66. Contacting surface 68 substantially prevents air flow from air supply slit 70 from mixing with this liquid. As a result the drainage slit 64 and the drainage channel 66 can be smaller than the air/liquid drain slit 72 and drainage channel 74 if desired since they do not have to carry a large amount of air. In the gap separating the working surface or channel 58 from the paper 18, the toning process and particle adhesion to the latent charge image occurs in substantially the same manner whether the toner stream moves with the paper motion to the left or against the paper motion to the right. The toner or wash fluid stream moving to the left towards the knife edge 76 encounters the opposed air stream and is driven downward through slit 72 to second drainage channel 74 in a manner essentially the same as described for FIG. 3.

The applicator embodiment shown in FIG. 4 has an advantage in that the liquid stream is divided into two separate flows in the "toning" channel so that the individual flows are lessened. This results in a reduced impedance to liquid flow thus reducing the maximum liquid back pressure and permitting a closer spacing of the channel 58 away from the paper web 18. The result of the closer spacing is improved toning efficiency and a reduction in overall size for this "bi-flow" embodiment. Preferably the gap thickness which separates toning channel 58 from the paper is in the range 0.003 to 0.004 inches or about 20 percent less than the "uni-flow" embodiment of FIG. 3. It is believed that the toning effectiveness of the embodiment of FIG. 4 is improved by more than 50 percent compared to the FIG. 3 embodiment. It should be realized that even more liquid toner supply channels and slits could be provided along with additional drain slits to further enhance toning efficiency. Such a more complex toning structure would be useful for very high paper web speeds. On completion of a toning pass air valves are opened in order to purge residual toner from the entire common volume including toner supply channel 62, and drainage channels 66 and 74 within the applicator. It should be understood that an additional line and air valve is required for the FIG. 4 embodiment as an additional drain line must be purged. If yet more toner supply and drain channels were used, such as for very high paper web speed, an additional jet air purge line and valve is required for each additional supply or drain channel. After toner purging, wash fluid is introduced into all supply and return lines and all purging air jet valves are closed so as to allow the liquid pump, not shown, to draw wash fluid and thoroughly wash the common volume. The wash process is repeated after each application of different colored toner.

If this invention is used for higher speed toning involving additional toner supply and drainage channels it may be necessary to use more powerful air supply means and a larger liquid pump. It is believed that this invention may thus be extended to extremely high paper web speeds almost without limit.

I claim:

1. A toner system for applying toner to the surface of a recording medium containing a latent electrostatic image comprising:

a toner applicator having a toning channel in fluid communication with said recording medium for applying toner to said recording medium, said toner applicator also having an air channel peripherally surrounding said toning channel, air supply means for directing air into said air channel surrounding said toning channel such that said toner is confined within said toning channel, a support backing for holding said recording medium in fluid communication with said toning channel, said support backing comprised of a planar member disposed above said recording medium such that said recording medium is disposed between said planar member and said toner applicator.

2. A toner system for applying toner to the surface of a recording medium comprising:

means for electrostatically charging a recording medium having opposed first and second surfaces, toner applicator means having a toning channel in fluid communication with said recording medium for applying toner to a first surface of said recording medium, said applicator means also having an air channel peripherally surrounding said toning channel, air supply means for directing air into said air channel surrounding said toning channel such that said toner is confined with said toning channel, support means for holding said recording medium in communication with said applicator means, said support means comprised of a planar member disposed above and facing the second surface of said recording medium such that said recording medium is disposed between said planar member and said toner applicator means.

3. A method for applying toner to the surface of a recording medium carrying a latent electrostatic image comprising the steps of:

peripherally surrounding a toner applicator channel with an air channel, supporting said recording medium in fluid communication with said toner applicator channel using a planar support backing member placed above and facing said recording medium such that said recording medium is disposed between said planar member and said toner applicator, bringing said recording medium into fluid contact with said toner applicator channel, supplying liquid toner to said toner application channel, and directing air into said air channel such that said toner is confined within said toner applicator channel.

* * * * *

UNITED STATES PATENT AND TRADEMARK OFFICE

CERTIFICATE OF CORRECTION

PATENT NO. : 5,268,721

DATED : December 7, 1993

INVENTOR(S) : Gene F. Day

It is certified that error appears in the above-indentified patent and that said Letters Patent is hereby corrected as shown below:

Column 1, line 12, "electoo-" should read - - electro- - -.

Column 1, line 31, "series" should read - - serves - -.

Claim 3, column 10, line 11, "toner application channel" should read - - toner applicator channel - -.

Signed and Sealed this

Tenth Day of May, 1994

Bruce Lehman

*Attest:*

BRUCE LEHMAN

*Attesting Officer*

*Commissioner of Patents and Trademarks*